United States Patent [19]

Lee

[11] Patent Number: 4,515,063

[45] Date of Patent: May 7, 1985

[54] TURRET PRESS FOR RELOADING RIFLE AND PISTOL CARTRIDGES

[76] Inventor: Richard J. Lee, 3146 Kettle Moraine, Hartford, Wis. 53027

[21] Appl. No.: 525,101

[22] Filed: Aug. 22, 1983

[51] Int. Cl.[3] ..... F42B 33/02

[52] U.S. Cl. ..... 86/27; 86/24; 86/44

[58] Field of Search ..... 86/23, 27, 28, 37, 24, 86/45, 46, 25, 31, 36, 39, 43, 32, 44

[56] References Cited

U.S. PATENT DOCUMENTS

| | | | |
|---|---|---|---|
| 3,060,788 | 10/1962 | Blesi et al. | 86/27 |
| 3,157,086 | 11/1964 | Bachhuber | 86/27 |
| 3,336,829 | 8/1967 | Lee | 86/27 |
| 3,408,892 | 11/1968 | Smith et al. | 86/23 |
| 3,610,090 | 10/1971 | Corcoran | 86/45 |
| 3,771,411 | 11/1973 | Hazel | 86/24 |
| 4,031,804 | 6/1977 | Boschi | 86/23 |
| 4,078,472 | 3/1978 | Simpson | 86/27 |
| 4,217,809 | 8/1980 | Hertzler | 86/23 |
| 4,343,222 | 8/1982 | Dillon | 86/23 |
| 4,393,744 | 7/1983 | Lee | 86/25 |

*Primary Examiner*—Stephen J. Lechert, Jr.
*Assistant Examiner*—Howard J. Locker
*Attorney, Agent, or Firm*—Fuller, House & Hohenfeldt

[57] ABSTRACT

Cartridge reloading presses wherein either a turret carrying multiple dies or a turret carrying multiple cartridges is caused to index rotationally relative to the axis of a vertically reciprocable ram. The indexing mechanism includes a ratchet element having a circular array of downwardly pointed teeth surrounding a vertical hole. This element is fixed to the ram. A hexagon rod having a nominal 120 degree twist near its lower end fits through said hole with clearance. A plastic ratchet element having upwardly pointed complementary teeth surrounding a hexagon hole fits snugly on the hexagon rod. When the ram moves upwardly the two ratchet elements are disengaged so the rod does not turn. During the ram downstroke, the ratchet elements engage while the plastic element is still on the untwisted part of the rod. Near the end of the downstroke, the engaged and locked plastic element runs onto the twist, causing the rod to rotate to thereby rotate a turret engaged therewith.

24 Claims, 11 Drawing Figures

TURRET PRESS FOR RELOADING RIFLE AND PISTOL CARTRIDGES

BACKGROUND OF THE INVENTION

This invention relates to a hand operated press for reloading cartridges used in pistols and rifles. The press performs the usual functions of removing spent primers from cartridges, inserting new primers, sizing the cartridges, refilling them with powder and inserting bullets in them.

Reloading presses typically comprise a base in which a ram is reciprocated vertically with a manually operable lever system. In one known type of press, a turret that has the dies or tools for performing the aforementioned reloading operations is supported in a ring above the base and the ram for manual indexing or rotation about a vertical axis. In this kind of reloading press, the spent cartridge is mounted in a holder at the upper end of the ram so that when the ram is driven upwardly, the cartridge will engage with a die for performing one of the reloading operations. After each operation, the turret is turned manually to align a different die with the cartridge on the ram for performing the next operation in the sequence leading to the final operation which is to insert a bullet in the cartridge.

As is evident, a turret press even though it requires manual indexing, permits loading cartridges faster than a single operation press because all of the dies can be mounted on the turret and progressively rotationally indexed over the ram to perform all of the reloading operations without removing the cartridge from the holder.

In another known type of turret press, the dies or tools are mounted in a fixed die head above the ram and the dies are arranged in a circle. In this case, a turret is mounted on the ram and is adapted to hold at least as many circularly arranged cartridges as there are dies on the head. Everytime the ram is retracted to near the lower limit of its stroke, the turret is rotated manually so that all cartridges on it will orbit about a vertical axis to align sequentially with the various dies in which case at least one reloading operation will be performed on each cartridge in the turret for every upstroke of the ram.

It has long been recognized that if the turret were automatically indexed, the reloading process could be expedited and made easier for the operator. Automatic turret indexing mechanisms have been developed. They are generally complex and expensive and not capable of being retrofitted to existing manually indexed turret presses. One is described in U.S. Pat. No. 4,078,472.

SUMMARY OF THE INVENTION

An object of the present invention is to provide a turret indexing mechanism that is simple in construction and reliable and is adapted for being incorporated in a reloading press of the type which has a rotating multiple cartridge supporting turret mounted on the ram or in the type of press in which a single cartridge is held on the ram and the turret that carries the multiple dies rotates and is mounted above the ram.

Another important feature of the new indexing mechanism is that it can be easily retrofitted to at least some presses which have manually indexed turrets, such as, for example, a press described in pending U.S. patent application, Ser. No. 280,677, filed July 6, 1981 by the applicant in this application.

Briefly stated, the new indexing mechanism is based on the use of a polygonal action rod on which an axially movable toothed ratchet element is closely fitted. There is another toothed ratchet element fixed axially of the first one. A simple axial twist or spiral in the rod at the place in the downstroke of the ram where indexing is desired, engages the ratchet elements to cause the rod to rotate the turret. On the reverse, or upward stroke of the ram, one of the ratchet elements is free to rotate backwards and get a new bite on the ratchet teeth. The number of sides on the polygonal action rod is equal the number of stations or a multiple of the number through which the turret will be indexed rotationally.

An important feature of the new indexing mechanism is that friction is minimized between the turret and its supporting ring during the rotary driving motion of the rod. Low friction is accomplished by having the rod coupled to the turret in such manner that downward pressure caused by the second ratchet element will not increase the friction of the turret on the ring in which the turret rotates.

The foregoing and other important features of the new indexing mechanism will now be described in greater detail in reference to the embodiments that are illustrated in the drawings.

DESCRIPTION OF A PREFERRED EMBODIMENT

Figure 1:
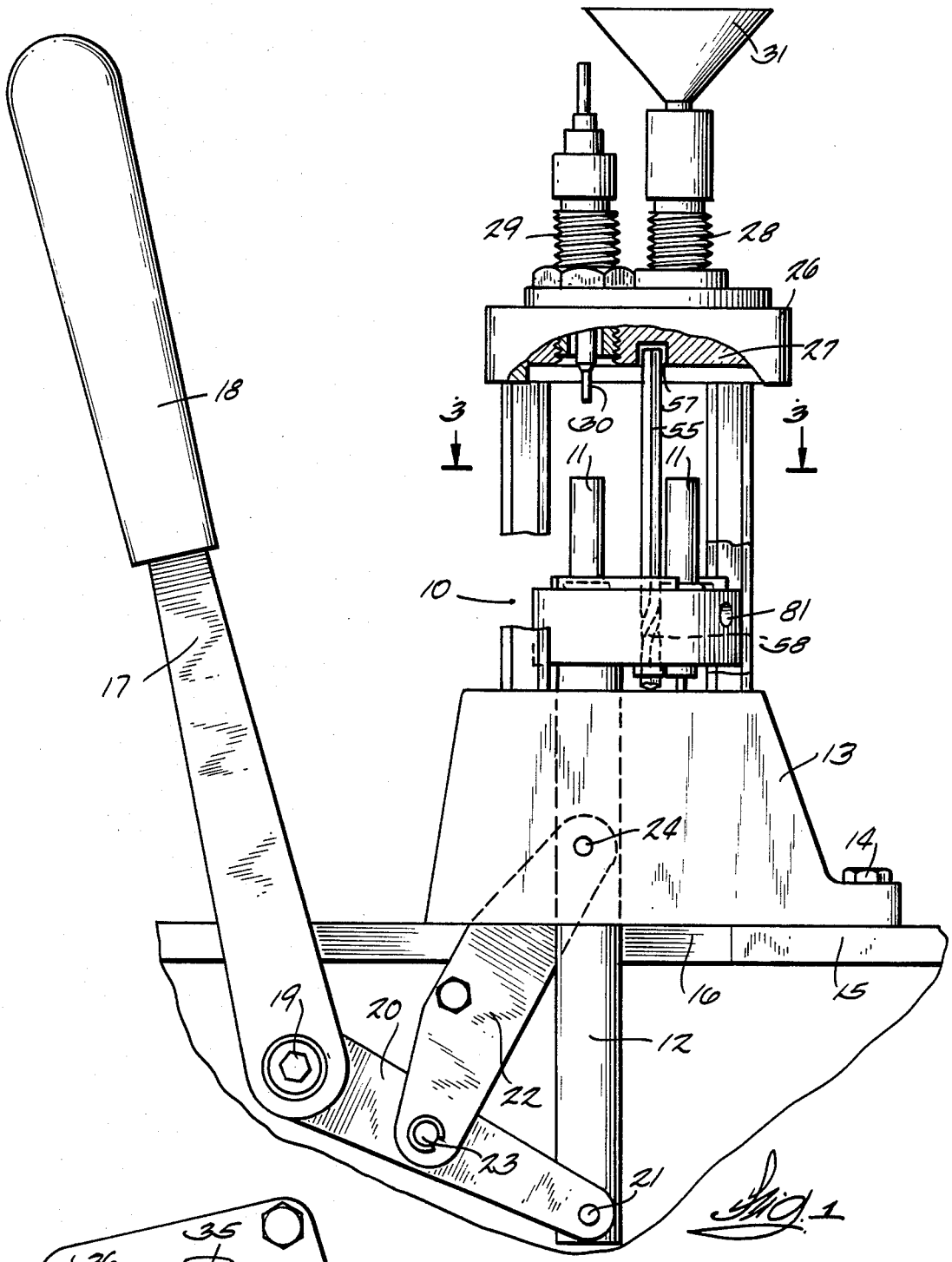
FIG. 1 is a side elevation view of a reloading press, with parts broken away, which incorporates the new turret indexing mechanism in the type of press wherein the turret carries a plurality of cartridges and is mounted to the ram of the press.

FIG. 1 shows a reloading press in which the turret, generally designated by the numeral 10, carries a plurality of cartridges 11 that are to be reloaded. The turret is mounted to a ram 12 which is guided in a sleeve bearing, not shown, fixed in a base 13. By means of bolts 14, the base is fastened to a plate 15 that has a slot 16 in which the ram 12 reciprocates. A known type of compound lever system having a toggle action drives ram 12 axially in opposite directions. The lever system comprises manually engageable lever 17 that has a hand-grip 18. This lever is rigidly clamped by a bolt 19 to a link 20 which pivotally connects at 21 to ram 12. Link 20 has another link assembly 22 pivotally connected to it with a pin 23. Link assembly 22 is pivotally connected to base 13 by means of pins such as the one marked 24.

Rotation of handle 17 counterclockwise from its FIG. 1 position causes ram 12 to be driven upwardly for performing one of the reloading operations on a cartridge 11. Link assemblies 20 and 22 execute a toggle action to maximize the driving force of the ram as it reaches the upper limits of its stroke.

In the FIG. 1 press, there are posts 25 that support a chamber 26. Chamber 26 has a die block 27 in it and tools or dies 28 and 29, for example, are screwed into die block 27. Die 29 performs the first operation in a reloading sequence which is removal of the spent primer cap from the cartridge. Die 29 has a pin 30 that drives out the primer and as cartridge 11 is driven axially of it, the mouth of the cartridge is reshaped or rounded. Die 28 has a funnel 31 extending from its top into which powder is poured for directing it to whatever cartridge 11 is presently aligned with die 28. When reloading is in progress, die block 27 does not have to rotate since cartridges 11 on the turret 10 are orbited in a step-by-step fashion into successive alignment with the various dies.

Figure 2:
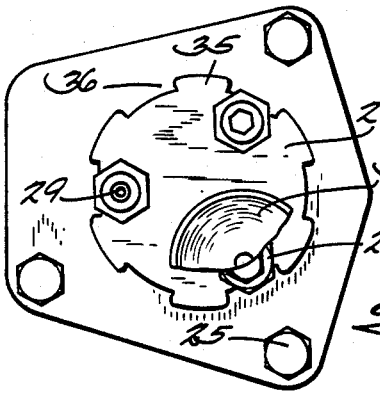
FIG. 2 is a top view of the press.

As shown in FIG. 2, die block 27 is generally circular and has radially extending tongues 35 that can fit through corresponding slots in the top of chamber 26 such that when the die block is twisted, the lugs turn under radially inward projections 36 which lock the block in the chamber. The lugs accept the axial force transmitted from the ram to the dies by way of the cartridges.

Figure 3:
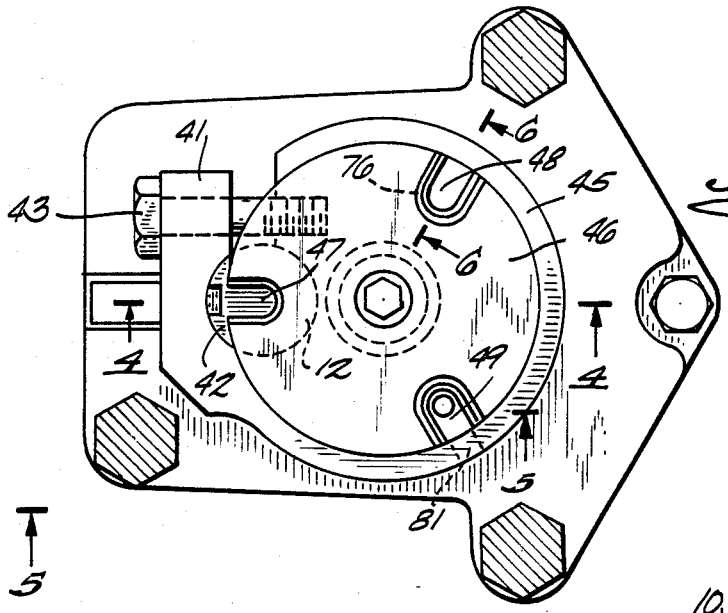
FIG. 3 is a horizontal section taken on a line corresponding with 3—3 in FIG. 1.
Figure 4:
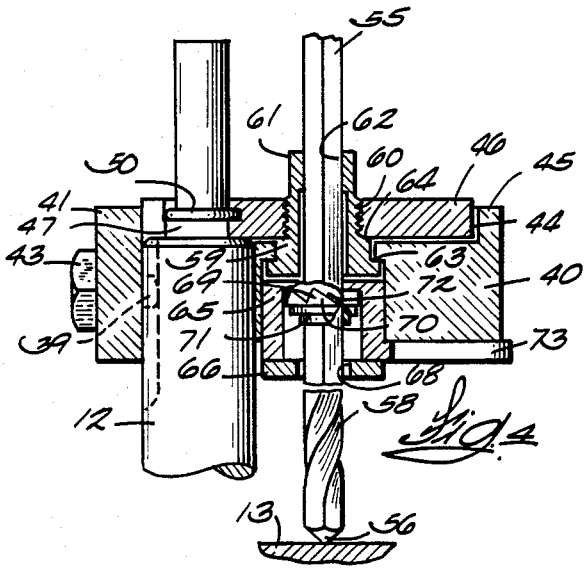
FIG. 4 is a vertical section taken on a line corresponding with 4—4 in FIG. 3, this figure showing the upper end of the ram, the turret ring attached to it, the turret itself and the drive or action rod and the ratchet mechanism.

The new turret rotating mechanism will now be described primarily in reference to FIGS. 3 and 4. The turret assembly 10 comprises a generally circular metal body 40. As shown in FIG. 3, a clamping arm 41 is formed integrally with the body. The arm has an arced recess 42 which has substantially the same radius as ram 12. A machine bolt 43 passes through the arc and is threaded into the body 40 so that when the bolt is tightened, the body will be clamped to ram 12. A dowel pin 39 enters a groove in the ram to assure proper alignment. The top of the body 40 has a shallow counterbore 44 that provides a rim 45. A disk-like cartridge holder turret 46 resides in counterbore 44. As can be seen most clearly in FIG. 3, the turret has three radial specially shaped slots 47, 48 and 49 for retaining a corresponding number of cartridges. In FIG. 3, one may see that slot 47 is presently indexed to an angle of rotation wherein it is not blocked by rim 45 in which case the body 40 is positioned for pushing a cartridge 11 into the slot which then engages the rim 50 of the cartridge as shown in FIG. 4. The cartridge holder turret 46 is indexed in the counterclockwise direction after each operation of the ram so that cartridge holder slots 48 and 49 reach the position in which slot 47 is presently disposed and indexing occurs during the time that the ram 12 is being retracted to its lowermost position.

The new mechanism that indexes turret 46 rotationally in equiangular steps comprises a polygonal action or torque rod 55. In the illustrated embodiments, rod 55 has a hexagonal cross-section. Ideally, rod 55 should have a number of sides equal to the number of stations or a multiple of the stations to which the turret must be angularly indexed. Hexagonal rod is readily available commercially so there is that advantage to using it. As can be seen in FIGS. 1 and 4, hexagonal rod 55 has a pointed tip 56 at its lower end which, when the turret is moving downward, bears on the top surface of base 13. The top end of rod 55 as shown in FIG. 1 resides in a recess 57 in die block 27. For reasons which will be discussed more fully later, when the assembly 10 containing turret 46 is being driven down by ram 12, the pointed tip 56 of rod 55 will bear on the top surface of base 13 and when the assembly 10 is driven upwardly, rod 55 will be forced upwardly sufficiently for its top end to come to a stop against the top of recess 57 in die block 27.

Figure 7:
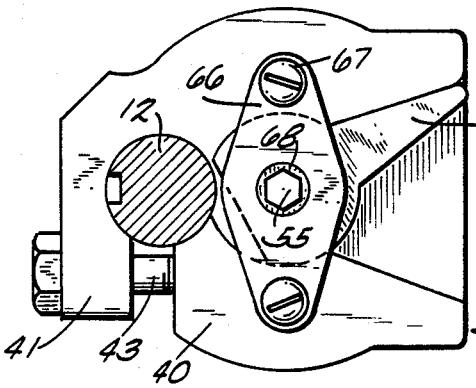
FIG. 7 is a view taken from the bottom of FIG. 4.

In FIG. 4 hexagonal turret indexing action rod 55 has an axial twist or spiral 58 which acts like a screw in cooperation with ratchet elements having interengageable teeth 70 and 72, as will be discussed shortly hereinafter. Observe first in FIG. 4 that turret body 40 has turret drive sleeve 59 fitted into it. The sleeve 59 has a threaded upper end 60 which is screwed into the turret disk 46. The top end 61 of the sleeve is flat on two sides to facilitate gripping it with a wrench for holding it back while the turret 46 is being tightened on to it. The upper end of sleeve 59 has a hexagonal internal axial bore so when rod 55 turns, turret disk 46 will turn correspondingly. A shoulder 63 on the insert maintains it in proper axial position in body 40 and another shoulder 64 acts as a stop for turret 46, although the latter is free to rotate with sleeve 59. There is a capsule 65 similar to an inverted cup whose top is next to the bottom of sleeve 59. The capsule is called the first ratchet element and is clamped against rotation in body 40 with a retainer plate 66 that is fastened to the bottom of body 40 with two machine screws 67 that are visible in FIG. 7. The retainer plate has a hole 68 through which action rod 55 passes freely.

Referring to FIG. 4, there is a second ratchet element 69 that fits closely on hexagon rod 55, and is desirably made of a plastic material having the properties of nylon. Ratchet element 69 has upwardly extending teeth 70 on it and a downwardly extending integral radially thin collar 71. There is an axial bore, not visible, through ratchet element 69. The part of the bore extending axially over the height of the teeth is hexagonal so nylon element 69 fits snuggly and slideably on action rod 55. The radially thin axially extending shoulder portion 71 has a circular bore and is sufficiently flexible to conform to the shape of the hexagonal rod 55 whereby it creates mild frictional engagement with the rod. Interiorly of the top of capsule 65 there is a circular array of first ratchet teeth 72 which surround a round clearance hole for rod 55 and which are complementary in shape with teeth 70 on resilient nylon ratchet element 69. Capsule 65 thus constitutes a second ratchet element which may be made of metal in this embodiment. Teeth 72 in the capsule 65 ratchet element are fixed since the capsule is clamped and retained by member 66. The term teeth is used herein in a generic sense to characterize any means for physically interengaging the two ratchet elements such as cogs or complementarily shaped pins and holes and the like. Capsule 65 has a radially extending arm 73 which is used to rotate the capsule and set its teeth 72 at a zero index angle before the capsule is clamped with retainer element 66. Ideally, when there are three equiangularly spaced working positions for the turret as in the FIGS. 1–4 embodiment, the hexagonal rod 55 could be twisted a minimum of 120 degrees in region 58. In practice, however, a 130 degree twist is used to compensate for possible manufacturing tolerances so there will be some override of the teeth on the ratchet elements to assure that one will get a new bite on the other for every ram stroke.

Operation of the multiple cartridge holding turret 46 indexing mechanism will now be discussed. Refer to FIG. 1 where the turret assembly 10 is presently in its lowermost position. Now assume that the ram 12 is being driven upwardly to carry the turret assembly with it. When the turret assembly is in transit along hexagonal rod 55, in the upward direction, there is no rotational action on rod 55, that is, nothing happens to rotate it or the turret 46. When the turret assembly 10 is moving upwardly, the tip 56 of the rod will be raised a small distance away from the top surface of base 13 and the rod will be carried up, one or two millimeters, for example, until its upper end strikes the top of recess 57. The rod is carried up because of the frictional engagement between the nylon ratchet member 69 and rod 55. This results from the collar 71 being tightly fitted on and conforming to the shape of the rod. During upward motion of the turret assembly 10, nylon ratchet element 69 will be resting on or near retainer plate 66 in FIG. 4 because the teeth 70 of the nylon ratchet element 69 will have been disengaged from the teeth 72 in capsule 65 previously during the downward movement of turret assembly 10.

Now assume that the turret assembly 10 is to be driven down to the position in which it is shown in FIG. 1 where the ram 12 is in its lowermost position. During downward movement, the frictional drag between the nylon ratchet element 69 and hexagonal rod 55 will bring the lower end point 56 of hexagonal rod 55 into bearing contact with the flat top surface of base 13. As downward movement of the turret assembly continues, the teeth 72 in the non-rotatable ratchet element capsule 65 will engage with teeth 70 on the nylon ratchet element which is only frictionally engaged with rod 55 and is above the twist 58 at this time. This important friction which prevents ratchet element 69 from sliding away from element 65 is developed with collar 71. As the ram and turret assembly 10 approach their lowermost position, the nylon ratchet element 69 will pass on to the nominal 120° or more twist or spiral 58 in hexagonal rod 55 whereupon the rod 55 will turn about its axis since the teeth 70 on the nylon element are engaged with the non-rotatable teeth 72 in the capsule ratchet element 65. Rotation of rod 55 will cause rotation of sleeve 59 in body 40 which will cause the cartridge holder plate constituting turret 46 to rotate at least 120°. As stated earlier, the hexagonal rod 55 will drive the sleeve because the rod passes snugly through hexagonal hole 62 in the sleeve.

A coil spring, not shown, could be used to assure engagement of the teeth 72 and 70 of the ratchet elements before the first or lower element 69 goes on to the spiral or twist 58. The coil spring could surround rod 55 and be interposed between the ratchet element 69 and clamping plate 66. In such case, the lower second ratchet element could be made of non-resilient material since a thin conformable collar 71 would not have to be relied on to grip the hexagonal rod.

On the reverse stroke of the ram in the illustrative embodiment, that is when upward movement of body 40 is started again, the nylon ratchet element 69 which has a hexagonal hole, is free to rotate backwards under the influence of spiral twist 58 in rod 55 to get a new bite on the ratchet teeth for the next operational cycle.

With a twist 58 in action rod 55, somewhat more than 120°, every downstroke of ram 12 will cause cartridge holder turret 46 to index rotationally through 120°. If, for example, there were four stations wherein a corresponding number of cartridges had to align simultaneously with the same number of dies, a 90° twist could be used so that the turret would turn 90° for every downstroke of the ram. In this case, the action rod and bore through the nylon ratchet element could be octagonal instead of hexagonal.

Figure 6:
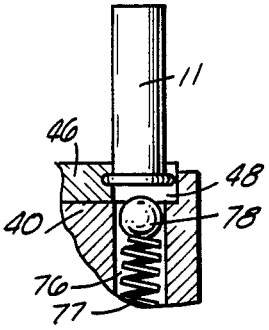
FIG. 6 is a fragmentary vertical section taken along a line corresponding to 6—6 in FIG. 3 and shows a spring and ball detent assembly for assuring that the turret is indexed to a predetermined position.

The reason for providing capsule or first ratchet element 65 with turning lever 73 will now be explained. As a last step in assembly of the press, the parts have to be related so that the turret stops in a rotational position corresponding to zero rotational angle at which time there is certainty that a cartridge being forced upwardly on the ram and turret into a die will align perfectly with the succession of dies at the end of each rotation. This depends on the angle through which hexagonal action rod 55 turns. Thus, for initial calibration, a test is made to determine if a cartridge 11 in the turret aligns properly with a die on the upstroke of the ram. If it does not, the ram is retracted and lever 73 is rotated to change the relative angular relationship between the fixed teeth 72 in the capsule and teeth 70 on the movable nylon ratchet element. After tightening the retainer plate 66 again, alignment will be maintained. The cartridge holding slots 47–49 in the turret 46 are in their exact desired angular positions in coincidence with the detent ball 78 shown in FIG. 6 becoming engaged in one of the cartridge slots. For this purpose, the turret body 40 has an axial hexagonal bore 76 and there is a spring 77 bottomed in the bore. The spring acts on a detent ball 78 which engages in the bottom of one of the slots in the position of slot 48 in the bottom of the cartridge holder or turret 46 and, by design, at this time all of the cartridges 11 will align with the dies such as those marked 28 and 29. Bore 76 is made hexagonal as an aid to letting fine dirt or powder drop through so the ball 78 does not jam.

A cartridge held in slot 47 of the turret 46, when in the position it is in in FIG. 3, will align with die 29 that contains the primer removing pin 30. Primer removal and cartridge shaping are the first operations in a reloading sequence. After indexing the turret 46 one time, the cartridge is in the position of slot 49 in FIG. 3 and can be rammed into the die 28 for being loaded with powder. Indexing next to the position of slot 48, positions the cartridge for having the bullet inserted. The next indexing step drives the refurbished cartridge to the position of slot 48 where the cartridge can be removed.

Figure 5:
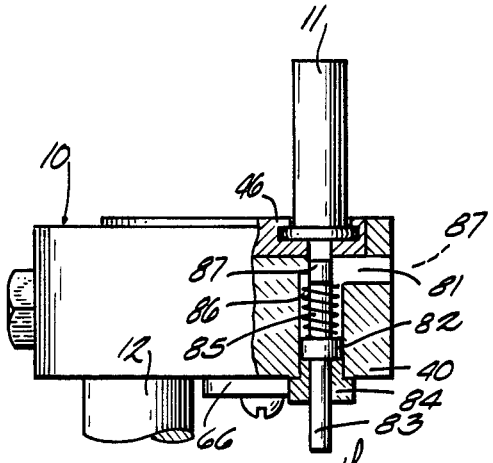
FIG. 5 is a vertical section taken on the irregular line 5—5 in FIG. 3 to show the arrangement for inserting primers in the cartridges.

New primer caps 87 are inserted in a cartridge 11 on the downstroke of the ram. The primers are fed by hand into the turret assembly through a tangential channel which is shown in FIGS. 1 and 3. The primer inserting arrangement is shown in FIG. 5. It is used on the downstroke of the ram. The turret body 40 is provided with a counterbore 82. There is a plunger 83 in the bore 82 whose stem is guided through a nut 84. There is a drive pin 85 on plunger 83 and it is surrounded by a spring 86. There is a small cavity 87 in the turret at the end of channel 81 above the plunger and the primer cap stops in the cavity. On the downstroke of the ram, the bottom tip of plunger 83 is driven against the top of base 13 in which case the plunger drives the primer cap out of cavity 87 into the rim end of cartridge 11. Then, on the upstroke the cartridge is ready to be filled with powder.

The reloading press shown in FIG. 8 wherein the turret that holds the tools or dies, rather than the cartridges, is rotated automatically, will now be discussed. The partially illustrated reloading press in FIG. 8 includes a base 100 that is comparable to base 13 in the previously discussed embodiment. The die block, or die head 101, is mounted in an open bottomed ring or cylindrical housing 102 for being indexed or rotated in 120° steps. One of the dies 103 that is screwed into die head 101 has a pin 30 for punching a spent primer cap out of a cartridge 104 and for reshaping the mouth of the cartridge so that it will accept a bullet properly. This is the first operation in a cartridge processing sequence. Another die that is illustrated is marked 105 and may be used, for example, to crimp a bullet in a cartridge that has been re-primed and filled with powder. Another die which may be used to conduct powder to a cartridge has been omitted from FIG. 8.

The circular die head 101 has radially extending and circumferentially spaced apart lugs 106 and the housing 102 has inwardly radially extending and circumferentially spaced apart lugs 107. Die head 101 is inserted in housing 102 by aligning its lugs 106 with the spaces between lugs 107 and then turning the die head about a vertical axis so the lugs on the die head will be under the lugs on the housing. Of course, during the time that the die head 101 is indexed or rotated, no axial force is applied to die head 101 so it is not forced out of housing 102 even though the lugs on the die head are in alignment with spaces between lugs on the housing momentarily.

Housing 102 is supported from base 100 on some posts 108. There is a vertically reciprocable ram 109 in base 100. The manual operating lever and linkage for driving ram 109 up and down has been omitted from FIG. 8 but may be similar to the ram operating mechanism in the FIG. 1 embodiment.

Figure 8:
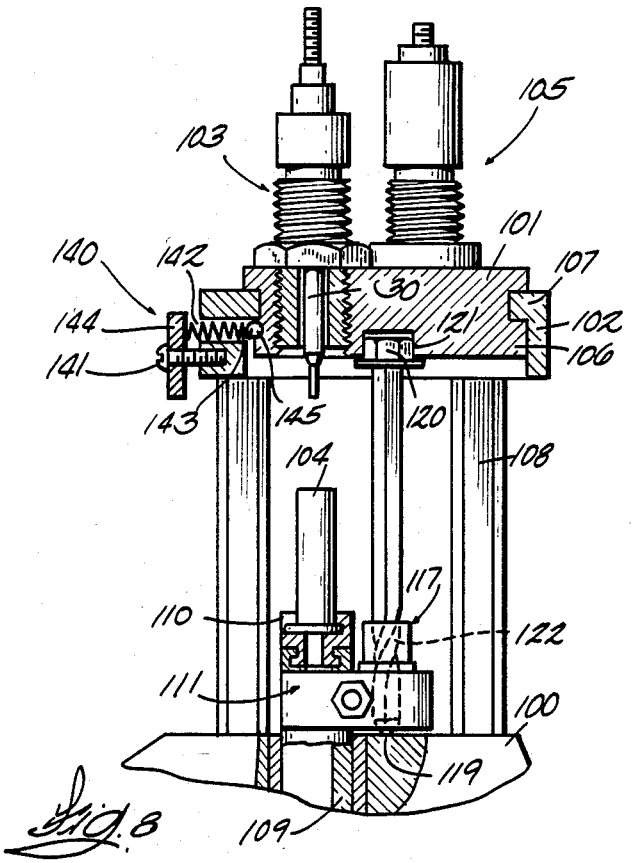
FIG. 8 shows a portion of another type of press wherein a block that carries the dies is indexed rotationally and a single cartridge that is to be reloaded is held by the ram.
Figure 10:
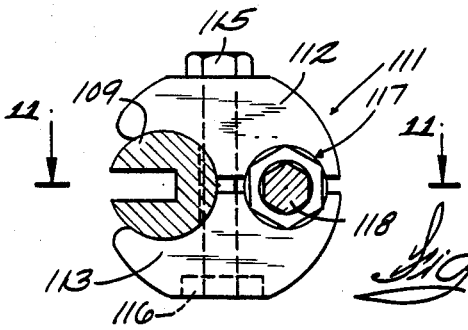
FIG. 10 is a horizontal section taken on a line corresponding 10—10 in FIG. 9.
Figure 9:
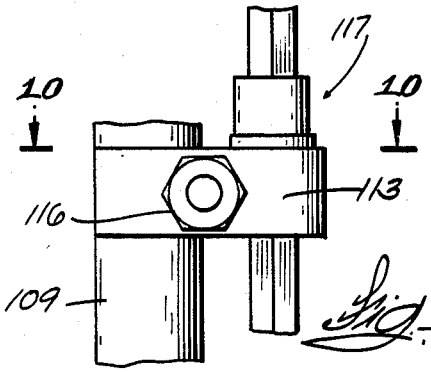
FIG. 9 is a side elevation view of a part of the ram and indexing mechanism in the FIG. 8 embodiment.

In FIG. 8 the upper end of ram 109 has a cartridge holder 110 and a cartridge 104 is shown installed on it. The ratchet device used for indexing die head 101 in equiangular rotation steps is designated generally by the reference numeral 111 in FIG. 8. As can be seen in FIG. 10, ratchet device 111 comprises a body made up of two nominally semi-circular parts 112 and 113. A bolt having a head 115 and a nut 116 is used to clamp the device to ram 109.

The indexing ratchet mechanism is designated generally by the reference numeral 117. It includes a preferably hexagonal index action rod 118 which has a lower pointed end 119 that bears against the top of base 100 at certain times during the reloading process as will be explained. Rod 118 has a flanged hexagonal nut 120 screwed on its upper threaded end. This nut resides in a recess 121 in the bottom of die head 101. Since the nut and recess are complementarily shaped, it will be evident that if hexagonal rod 118 is turned, die head 101 will be driven rotationally. Where there are three tool or die stations that must act on a single cartridge 104, die head 101 must be indexed rotationally in 120° steps. Thus, rod 118 is given a minimum of a 120° twist 122 near its lower end as was the case in the previously discussed embodiment. It should be noted that the hexagon nut 120 at the top of hexagon rod 118 makes a sliding fit in recess 121 so that rod 118 will drop down for point 119 to bear on the top of base 100 during the downstroke of the ram 109, particularly at the time the ratchet mechanism is imposing a downward force on vertical hexagonal rod 118. The advantage of this sliding fit is that no downward force will be imposed on die head 101 which would disadvantageously increase friction between die head 101 and housing 102. Thus, less force has to be applied to the ram operating lever on the ram downstroke at which time the die head 101 is rotated.

Figure 11:
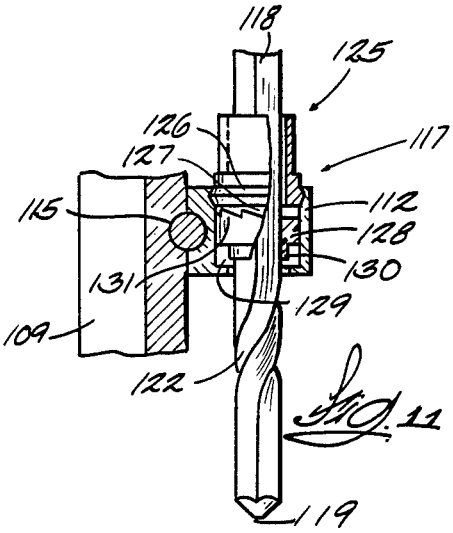
FIG. 11 is a partial vertical section taken on a line corresponding with 11—11 in FIG. 10.

The ratchet or clutch mechanism 117 is shown in detail in FIG. 11. There is a tubular first ratchet element 125 that is clamped tightly between parts 112 and 113 of the body by means of bolt 115. Element 125 is provided with a radially extending rim or flange 126 which aids in positioning it at the proper place axially. Element 125 also has some downwardly extending ratchet teeth 127. A plastic, preferably nylon, second ratchet element 128 is fitted on hexagonal rod 118 within the space 129. Ratchet element 128 has upwardly extending teeth 131 and an integral radially thin deformable collar portion 130 which fits through a hole in the bottom of cavity 129. The collar portion has a round bore that fits tightly on hexagon rod 118 for obtaining friction as in the previous embodiment. Nylon ratchet element 128 is free to rotate within cavity 129. Nylon element 128 has a hexagon axial bore, and fits with frictional drag on rod 118. There is a clearance axial bore in fixed ratchet element 125 so rod 118 passes through freely.

In reference to FIG. 11, assume that ram 109 is being forced downwardly and that the device is just about ready to reach the spiral or twisted portion 122 of action rod 118. When the nylon ratchet element 128, which has a hexagonal axial hole, begins to slide onto the twist 122, the frictional effect brings its teeth 131 into engagement with the teeth 127 of upper ratchet element 125. This prevents the lower nylon ratchet element 128 from turning. Now, since there is a downward force caused by downward movement of the ram, and the nylon second or lower ratchet element 128 is held against rotation by engagement with upper fixed first element 125, the action of the spiral having the now fixed lower ratchet element sliding over it, is to rotate hexagonal index action rod 118. In an actual embodiment, rotation of action rod 118 begins at about the time the ram and ratchet device are at about one inch from the end of the ram stroke. As the nylon ratchet 128 passes over the twisted portion 122 of the rod 118, the friction between these elements pulls hexagonal action rod 118 downwardly slightly so that its lower pointed tip 119 bears on the top of base 100 and because of the sliding action between nut 120 and recess 121, no downward pull is exerted on die head 101 so its rotational friction is minimized. Thus, the die head turns with a minimum of manual force being applied to the operating lever for the ram and less stress is imposed on the nylon element.

Assume now that the ratchet device is at the bottom of its stroke, that is, below or past the spiral or twist 122 in rod 118. Now the ram is about to be forced upwardly so that at the uppermost part of its stroke, one of the reloading operations will be performed on cartridge 104. When the ram starts to move upwardly, a slight frictional drag between the nylon second ratchet element 128 and rod 118 causes the teeth of the two ratchet elements to unmesh and separate axially. In other words, the nylon ratchet element rests on the bottom of cavity 129 and there is a space between the teeth on the two ratchet elements. Now since the lower nylon ratchet element 128 is not held against rotation, it simply slides over the spiral portion 122 and does not rotate hexagonal action rod 118.

A detent device 140 is provided for assuring that the die head 101 will stop at exactly 120° of rotation each time it is indexed as shown in FIG. 8. The device comprises a screw 141 turned tightly into housing 102. There is a spring 142 in a radial bore in the housing and the spring is interposed between a detent ball 143 and a knurled thumb wheel 144. The thumb wheel can be turned in or out on screw 141 to change the spring force acting on ball 143. In this embodiment there are three indentations 145 spaced exactly 120° apart around the periphery of die head 101. The ball 143 is set in an indentation 145 when the die head turns exactly 120° from its previous position.

In summary, use of the torque or action rod and ratchet mechanism has been shown to be capable of turning a multiple shell holder turret that is mounted on a ram or turning a die head or turret that is mounted independently of the ram. In both cases, rotation is effected near the end of the downstroke of the ram. Moreover, in both cases no axial load is imposed by the action rod on the die head so that its friction is minimized and the ratchet can develop enough force to turn the rod without having the ratchet slip.

Although two embodiments of the spiral rod ratchet indexing mechanism has been described in detail, such description is intended to be illustrative rather than limiting, for the invention may be variously embodied and this would be limited only by interpretation of the claims which follow.

I claim:

1. Ammunition cartridge reloading apparatus comprising:

a base, a member for executing alternate linear upstrokes and downstrokes, and means for driving said member reversibly, a body mounted to said member, a first ratchet element secured in said body, said element having a bore whose axis parallels the line of movement of said member and having longitudinally directed teeth adjacent the bore, a longitudinally extending indexing rod having a polygonal cross section and extending through said bore without engaging said first ratchet element, said rod having a region over which it is twisted about its axis through a predetermined angle, a second ratchet element having a bore that is similarly polygonal in cross section and of substantially the same size as said rod and fitting slidably on the rod, said second ratchet element having teeth adjacent said bore directed toward the teeth on the first element and selectively engageable with and separable from the teeth on the first ratchet element, means for limiting the distance through which said second ratchet element can become separated on the indexing rod from the first element, and rotatable turret means and means coupling said indexing rod to the turret means, initiating the downstroke of said member after an upstroke, causing said first ratchet element to engage the second ratchet element such that when said second ratchet element advances over said twisted region on the indexing rod, said rod is forced to rotate and index said turret substantially through said predetermined angle, and initiating the upstroke of said member causing said ratchet elements to separate so the second element will slide over the twisted portion of the rod without rotating it.

2. The apparatus according to claim 1 wherein said turret means is carried on said body that is mounted to said member, said means for coupling the indexing rod to the turret means is a sleeve means rotatable in said body and restrained against moving axially in the body, said sleeve means having a polygonal longitudinal hole for fitting slidably on said indexing rod and corresponding substantially to the polygonal shape of the rod for the sleeve means to be driven rotationally, said turret means being fastened co-axially to the sleeve means, said turret means having a plurality of angularly spaced apart slot means for holding a corresponding plurality of cartridges in a circular arrangement, and a die head mounted above said base for holding a plurality of dies in equiangularly spaced relationship and in circular arrangement corresponding to that of the cartridges such that each cartridge will engage with all of the dies in sequence as a result of rotationally indexing the turret.

3. The apparatus according to claim 2 wherein the upper end of said indexing rod is rotatable in and slidable longitudinally in said die head by a small amount in opposite directions and the lower end of said rod is pointed, such that during the downstroke of said member and the sleeve and the turret, said pointed end will bear on said base and produce minimum frictional resistance to rod rotation.

4. The apparatus according to any one of claims 1, 2 or 3 wherein said second ratchet element is composed of plastic material.

5. The apparatus according to any one of claims 1, 2 or 3 wherein said second ratchet element is composed of nylon.

6. The apparatus according to any one of claims 1, 2 or 3 wherein said second ratchet element is composed of resilient plastic material and has a radially thin collar portion extending integrally and longitudinally therefrom oppositely of said teeth, said collar portion having a bore that is conformed by the resiliency to the shape of the polygonal rod to create friction with the rod on the downstroke of said member.

7. The apparatus according to any one of claims 1, 2 or 3 wherein said polygonal indexing rod is a hexagonal rod and is twisted a minimum of 120 degrees.

8. The apparatus according to any one of claims 1, 2 or 3 wherein said polygonal rod is a hexagonal rod and is twisted a minimum of 120 degrees and there are three cartridge holder slot means on said turret angularly spaced apart by 120 degrees.

9. The apparatus according to claim 4 wherein said material composing said second ratchet element is nylon.

10. The apparatus according to claim 1 including a housing having a bore and fixedly mounted above said member and base, said turret means comprising a die head rotatable in said bore and having radially extending means bearing on the rim of said bore, said turret means having circularly and equiangularly arranged holes for retaining dies to perform operations on cartridges, the lower tip of said indexing rod on one side of said twisted region being proximate to said base and the end of said rod on the opposite side of said twisted region being engaged with said turret means for rotating the turret means and for sliding in opposite longitudinal directions by a limited amount, such that during a downstroke of said member, said tip bears on said base and said rod exerts no downward force on the turret means to thereby minimize friction between the turret means and housing and reduce the torsional force that must be transmitted by said plastic ratchet element as it passes over said twisted portion to turn the rod, and a cartridge holder on said member aligned with the circle on which said die retaining holes in the turret means are disposed.

11. The apparatus according to claim 10 wherein said lower tip of said index rod is shaped to make point contact with said base.

12. The apparatus according to claim 10 wherein said ratchet element is composed of resilient plastic material.

13. The apparatus according to claim 10 wherein said second ratchet element is composed of nylon.

14. The apparatus according to any one of claims 10, 11, 12 or 13 wherein said polygonal indexing rod is a hexagonal rod and is twisted a minimum of 120 degrees and said die retaining holes in the turret means are spaced apart angularly by 120 degrees.

15. Ammunition cartridge reloading apparatus comprising:

a base, a member mounted for moving relative to said base for executing alternate linear upstrokes and downstrokes and means for driving said member reversibly, a die head mounted in fixed spaced relationship with respect to the base and above the base, said die head having a plurality of circularly and equiangularly arranged holes for retaining dies that respectively operate on cartridges, a body mounted to said member, a first ratchet element secured against rotation in said body, said element having a bore whose axis is parallel to the line of movement of said member and having longitudinally directed teeth surrounding the bore within a cavity in said body.

a hexagonal indexing rod extending longitudinally through said bore without engaging said first ratchet element, the upper end of said rod extending into said die head for freely rotating therein and the lower end of said rod being proximate to said base for rotating thereon, said rod having a region which is twisted about its axis through a predetermined angle, a second ratchet element comprised of resilient plastic material and having a hexagonal bore of substantially the same size as said rod and fitting frictionally and slidably on said rod and slidably in said cavity, said second ratchet element having teeth surrounding its bore directed toward the teeth on the first element and selectively engageable with and separable from the teeth on the first ratchet element, turret means supported for rotation in said body and constrained against longitudinal movement thereon, said turret means having a plurality of circularly and equiangularly arranged slot means for holding a corresponding plurality of cartridges, said hexagonal indexing rod extending through a corresponding hexagonal bore centrally of said turret means so rotation of said rod will index said turret means rotationally, initiating a downstroke of said member after and upstroke causing said secured first ratchet element to engage said slidable second plastic ratchet element in said cavity such that when said second element advances over said twisted portion of the indexing rod, said rod turns and drives said turret means rotationally through said predetermined angle, and initiating an upstroke of said member causes said elements to separate so said second element slides on said twisted portion without rotating the rod.

16. The apparatus according to claim 15 wherein said plastic second ratchet element has a radially thin collar portion extending integrally and longitudinally oppositely from said teeth, said collar portion having a bore that is conformed by said resiliency to the shape of said hexagonal rod to create friction with the rod on the downstroke of the ram.

17. The apparatus according to any one of claims 15 or 16 wherein the plastic material composing said second ratchet element is nylon.

18. The apparatus according to claim 15 wherein said hexagonal rod is twisted a minimum of 120 degrees and there are three cartridge holder slot means on said turret means angularly spaced apart by 120 degrees.

19. The apparatus according to claim 15 wherein said lower end of the indexing rod is shaped for making point contact with said base to minimize friction between the rod and base when the rod is rotating.

20. Ammunition cartridge reloading apparatus comprising:

a base, a member mounted for executing alternate linear upstrokes and downstrokes relative to said base, said member having means for holding a cartridge to be reloaded, means for driving said member reversibly, support means fixedly mounted above said member and base and a generally circular turret means mounted for rotation in said support means and constrained against longitudinal movement while in predetermined rotational positions, said turret means having a plurality of circularly and equiangularly arranged holes for retaining dies that successively operate on cartridges held by said member, a body mounted to said member, a first ratchet element secured against rotation in said body, said element having a bore whose axis is parallel to the line of movement of said member and having longitudinally directed teeth surrounding the bore in a cavity in the body, a hexagonal indexing rod extending longitudinally through said bore without engaging said first ratchet element, said rod having means at its upper end forming a rotational driving connection with said turret means while permitting said rod to move freely longitudinally through said bore without engaging said first ratchet element, said rod having means at its upper end forming a rotational driving connection with said turret means while permitting said rod to move freely longitudinally so the lower end of said rod can bear on said base, said rod having a region which is twisted about the rod axis through a predetermined angle, a second ratchet element comprised of resilient plastic material and having a hexagonal bore of substantially the same size as the rod for fitting frictionally and slidably on the rod and slidably longitudinally in said cavity, said second ratchet element having teeth surrounding its bore directed toward the teeth on said first ratchet element and selectively engageable with and separable from the teeth on said first secured ratchet element, initiating a downstroke of said member after an upstroke causing said secured first ratchet element to engage said second ratchet element in said cavity such that when said second element advances over said twisted portion of the indexing rod, said rod rotates and drives said turret means rotationally through said predetermined angle, and initiating an upstroke of said member causes said ratchet elements to separate so said second element slides on said twisted portion without rotating the rod.

21. The apparatus according to claim 20 wherein said plastic second ratchet element has a radially thin collar portion extending integrally and longitudinally oppositely from said teeth, said collar portion having a bore that is conformed by said resiliency to the shape of said hexagonal rod to create friction with said rod on the downstroke.

22. The apparatus according to any one of claims 20 or 21 wherein the plastic material composing said second ratchet element is nylon.

23. The apparatus according to claim 20 wherein said hexagonal rod is twisted a minimum of 120 degrees and said die retaining holes in said rotatable turret means are spaced apart 120 degrees.

24. The apparatus according to claim 20 wherein said lower end of the indexing rod is shaped for making point contact with said base to minimize friction between the rod and base when the rod is rotating.

* * * * *